US006213063B1

(12) United States Patent
Nakano et al.

(10) Patent No.: US 6,213,063 B1
(45) Date of Patent: Apr. 10, 2001

(54) ENGINE WATER PUMP STRUCTURE

(75) Inventors: Shinichi Nakano; Katsunori Takahashi; Tomoo Oka, all of Saitama; Yoshiki Suzuki; Chutaro Kobayashi, both of Shizuoka, all of (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/395,737

(22) Filed: Sep. 14, 1999

(30) Foreign Application Priority Data

Sep. 14, 1998 (JP) ..... 10-279429

(51) Int. Cl.[7] ..... F01P 5/10
(52) U.S. Cl. ..... 123/41.44
(58) Field of Search ..... 123/41.44, 41.46, 123/41.47; 29/888.02, 888.025; 417/423.14; 464/183; 415/216.1, 111, 112, 122.1

(56) References Cited

U.S. PATENT DOCUMENTS 869,887 * 11/1907 Duryea .

* cited by examiner

*Primary Examiner*—Willis R. Wolfe
*Assistant Examiner*—Katrina B. Harris
(74) *Attorney, Agent, or Firm*—Birch, Stewart, Kolasch & Birch, LLP

(57) ABSTRACT

A water pump includes a pump body and a pump cover. An impeller is housed in a pump chamber defined by the pump body and pump cover. The impeller is attached to one end of a hollow pump shaft. The pump shaft is engaged with a driving section at its other end. An intermediate part of the pump shaft is supported by a shaft support section, in the form of a cylindrical section, of the pump body. The shaft support section is longer than a diameter of the pump shaft. The shaft support section is lubricated via an oil groove. One end of the shaft support section is brought into contact with a flange of the pump shaft via a washer. The flange is integrally formed on the pump shaft by a beading process.

21 Claims, 3 Drawing Sheets

ENGINE WATER PUMP STRUCTURE

BACKGROUND OF THE INVENTION

1. Field of the Invention

The present invention relates to a water pump for a water-cooled engine.

2. Description of Related Art

Japanese Utility Model Publication No. Hei 6-31197 discloses a structure of a water pump for a water-cooled engine of a motorcycle. In the water pump, an impeller is attached to one end of a hollow pump shaft, and a pump gear is attached to the other end of the pump shaft. The pump gear rotates in response to rotation of a crankshaft. The pump shaft is supported by a crankcase of the crankshaft.

The pump gear receives a thrust load from a pin. The pin has its opposite ends supported in the crankcase via the pump gear and is orthogonal to the crankcase. The pump gear is surface-supported by the crankcase.

In order to receive the thrust load by the pin, as described above, a drilling process and a force-fitting process are required in order to install the pin. Therefore, the number of components, including the pin itself, is increased. Further, the manufacturing and repair process is difficult. In order to support the pump shaft at the opposite ends thereof, the pump shaft should be centered very precisely. Therefore, the pump shaft is preferably supported at one end thereof

SUMMARY OF THE INVENTION

It is an object of the present invention to overcome one or more of the drawbacks associated with the background art.

It is a further object of the present invention to provide a water pump including a water pump shaft for rotatably supporting a water pump impeller, wherein the water pump shaft is directly and rotatably attached to a water pump body via a shaft support section.

It is a further object of the present invention to provide a water pump including a water pump shaft having an engaging portion formed at one end, opposite to an end where the impeller is supported.

It is a further object of the present invention to provide a method of forming a water pump shaft including a flange.

These and other objects are accomplished by providing a water pump for an engine comprising: a water pump body having an approximately cylindrical support section of a first diameter and a first length, wherein said first length is longer than said first diameter; a water pump shaft having a first end, a second end, and a second diameter, said second diameter being approximately equal to said first diameter, said water pump shaft lying within said cylindrical support section to be directly and rotatably attached to said water pump body; a water pump impeller included proximate said first end; and an engaging portion included proximate said second end for causing said water pump shaft and said water pump impeller to rotate relative to said water pump body.

Further, these and other objects are accomplished by providing an engine comprising: a crank case; a crank shaft rotatably mounted in said crank case; a driven member interacting with said crank shaft to rotate in response to rotation of said crankshaft; a first engaging member connected to said driven member to rotate therewith; a water pump body attached to said engine; a water pump shaft having a first end and a second end, said water pump shaft being directly and rotatably attached to said water pump body; a water pump impeller included proximate said first end; and a second engaging member included proximate said second end, said second engaging member being engaged by said first engaging member to cause said water pump shaft and said water pump impeller to rotate in response to rotation of said first engaging member.

Moreover, these and other objects are accomplished by providing a method of forming a water pump shaft of a water pump comprising the steps of: providing a die with a cylindrical opening of a first diameter formed therein; a punch having a circular groove formed in an end thereof with a protruding cylindrical portion inside the circular groove, the cylindrical protruding portion having a second diameter; and a hollow shaft with a third outer diameter approximately equal to the first diameter and a fourth inner diameter approximately equal to the second diameter; inserting one end of the hollow shaft into the circular opening of the die; inserting the cylindrical protruding portion into the hollow shaft until the hollow shaft seats into the circular groove; moving the punch toward the die; inserting the cylindrical protruding portion into the circular opening; and bending the hollow shaft in a radial direction at a point where the hollow shaft enters the die.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIG. 3(*b*) illustrates a second step in forming the water pump shaft;

FIG. 3(*c*) illustrates a third step in forming the water pump shaft;

FIG. 3(*d*) illustrates a fourth step in forming the water pump shaft; and

FIG. 3(*e*) illustrates a fifth step in forming the water pump shaft.

DESCRIPTION OF PREFERRED EMBODIMENTS

Figure 2:
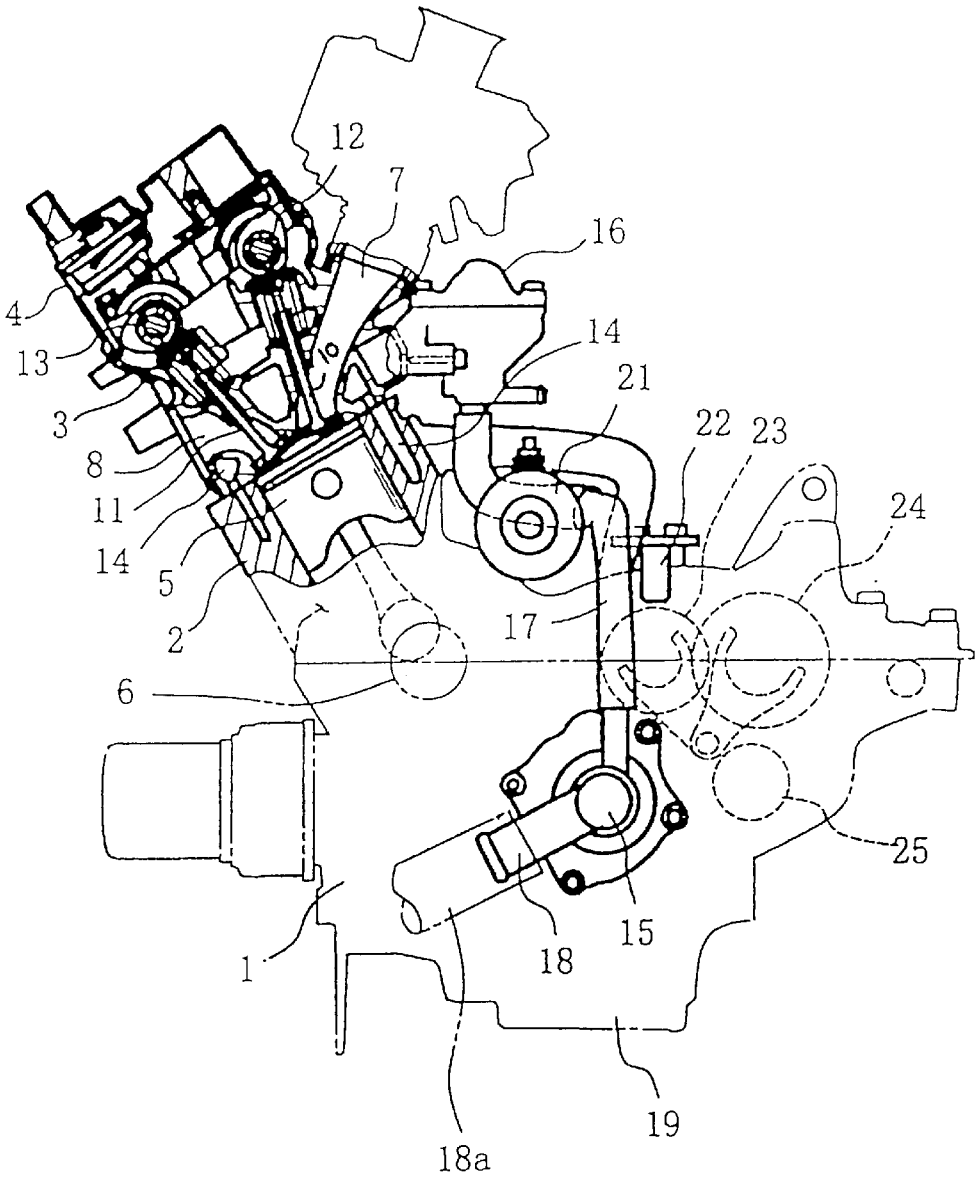
FIG. 2 is a partial cross sectional view of an engine in combination with the water pump of FIG. 1.

An engine structure will be outlined with reference to FIG. 2. The engine is a water-cooled four-cycle DOHC (double overhead camshaft) engine. The engine includes a crankcase 1, a cylinder 2, a cylinder head 3, and a cylinder head cover 4 which is a part of the cylinder head 3. A piston 5 is slidably housed in the cylinder 2 and is coupled to a crankshaft 6 (the center thereof is shown in FIG. 2) in the crankcase 1. A combustion chamber is provided between the piston 5, cylinder 2 and cylinder head 3.

An inlet port 7 and an exhaust port 8 are provided on the cylinder head 3 and communicate with the combustion chamber. The inlet port 7 and exhaust port 8 are opened and closed by an inlet valve 10 and an exhaust valve 11, respectively. The inlet valve 10 end exhaust valve 11 are driven by cams on camshafts 12 and 13, which are rotated in synchronization with the crankshaft 6.

A water jacket 14 is provided on the cylinder 2 and the cylinder head 3, and receives cooling water from a water pump 15 disposed in the crankcase 1. Water heated in a cooling process is fed to a radiator (not shown) via a thermostat 16 attached on the cylinder head 3. The water is cooled by the radiator, and is then returned to the water pump 15.

The thermostat 16 is provided with a bypass circuit including a bypass hose 17 connected to the water pump 15. When a water temperature is below a predetermined value, a thermostat valve is switched over to the bypass circuit, so that cooling water heated by the engine is not fed to the radiator, but is directly returned to the water pump 15 via the bypass hose 17.

In FIG. 2, an inlet pipe 18 receives cooling water, supplied from the radiator via a hose 18A. The engine also includes an oil pan 19, a starting motor 21, and a speed sensor 22 connected to a transmission. The speed sensor 22 is disposed on a main shaft 23 of the transmission. Further, the engine includes a countershaft 24, and a shift drum 25.

Figure 1:
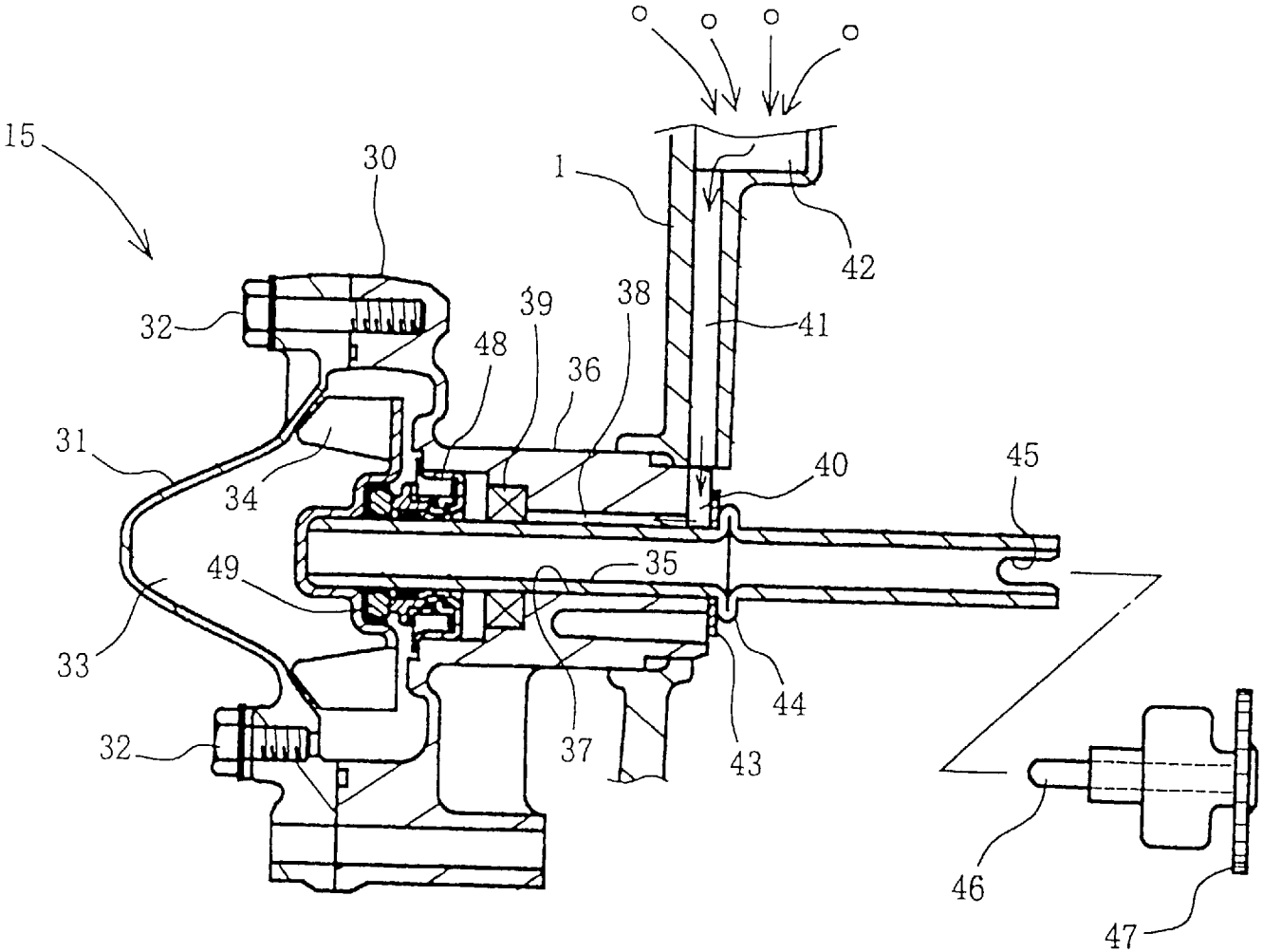
FIG. 1 is a cross sectional view of a water pump, in accordance with the present invention.

A detailed structure of the water pump 15 will now be described with reference to FIG. 1. The water pump 15 includes a pump body 30, and a pump cover 31, both of which are united by bolts 32. The pump body 30 is coupled to the crankcase 1. An impeller 34 is housed in a pump chamber 33 defined between the pump body 30 and the pump cover 31.

The impeller 34 is force-fitted to one end of a pump shaft 35 in order to be connected thereto. The pump shaft 35 is hollow, has its one end blocked by the impeller 34, and has its intermediate part received in a shaft support section 37 of a cylindrical part 36 formed in the pump body 30. A length of the shaft support section 37 is larger than a diameter of the pump shaft 35. In a prefeffed embodiment, the length is approximately three times the diameter of the pump shaft 35.

The shaft support section 37 is constituted by an inner surface of a through hole formed in the cylindrical member 36. The shaft support section 37 is partially and axially provided with an oil supplying groove 38. The oil supplying groove 38 is blocked by a seal 39 at one end thereof, and communicates with one end of an oil supplying opening 41, formed on an inner surface of the crankcase 1, via a radial opening 40. The oil supplying opening 41 communicates with an oil collecting recess 42 having an open top. Oil circulating, or dispersing, in the crankcase 1 is collected in the oil collecting recess 42, and is supplied to the shaft support section 37 via the oil supplying opening 41 and the radial opening 40.

An inner end of the cylindrical member 36 housed in the crankcase 1 is brought into contact with a flange 44 of the pump shaft 35 via a washer 43. The flange 44 is radially formed on the pump shaft 35 by a bending, or beading, process, as will be described later. The flange 44 is integral with the pump shaft 35.

The other end of the pump shaft 35 has a joint 45 in the shape of a notch. The joint 45 is engaged by a projecting of a driving shaft 46, so that the driving shaft 46 and the pump shaft 35 rotate together. The driving shaft 46 is connected to a pump gear 47. The pump gear 47 is supported by the crankcase 1 separately from the water pump 15. The pump gear 47 rotates in response to rotation of the crankshaft 6.

A mechanical seal 48 is provided between an outer surface of the pump shaft 35 and the pump body 30 at the end of the pump shaft 35 where the impeller 34 is attached. The mechanical seal 48 is in contact with the impeller 34 via a floating seat 49.

Figure 3:
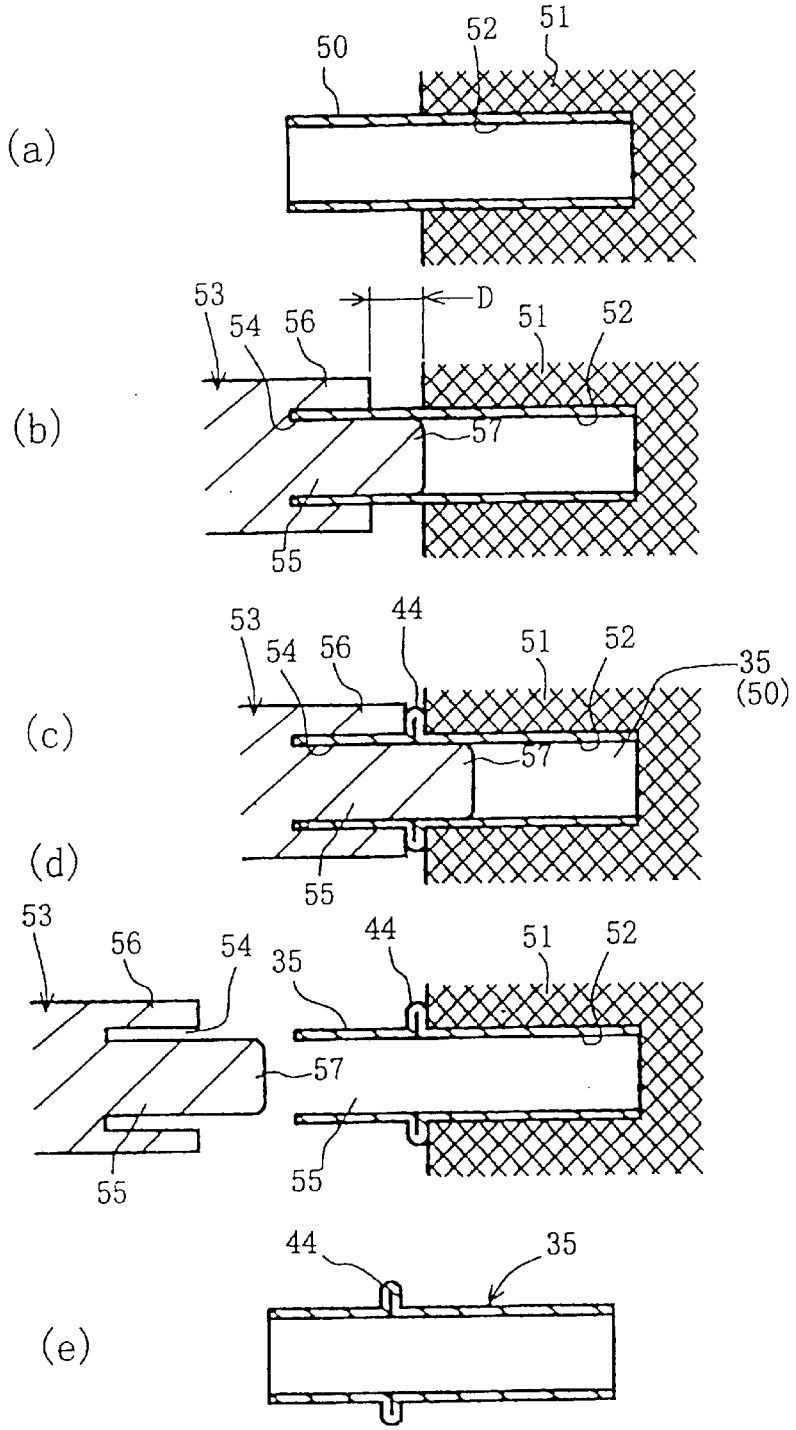
FIG. 3(*a*) illustrates a first step in forming a water pump shaft of the water pump of FIG. 1.

Now reference will be made to FIGS. 3(*a*) through 3(*e*) to describe a method of forming the flange on the pump shaft 35. In FIG. 3(*a*), one end of a straight pipe material 50 is inserted into an opening 52 of a die, or dies 51, and is held therein. The opening 52 has an inner diameter that is substantially equal to an outer diameter of the pipe material 50. The opening 52 has a depth that is equal to a distance between one end of the pump shaft 35 and the flange 44.

In FIG. 3(*b*), the other end of the pipe material 50, projecting from the dies 51, is fitted into a punch 53. The punch 53 has an annular groove 54 for engagement with the projecting end of the pipe material 50. A portion 55 of the punch 53 inside the annular groove 54 is fitted into the pipe material 50. A portion 756 of the punch 53 outside the annular groove 54 recedes from a tip 57 of the portion 56 by a size D.

FIG. 3(*c*) illustrates a state when the punch 53 is pressed and moved toward the dies 51. A part of the pipe material 50 that is not covered by the dies 51 and the punch 53 bends or projects radially to form the flange 44. Thus, the pipe shaft 35 has the flange 44 extending around its circumference. The size of the flange 44 can be set as desired by adjusting the size D.

In FIG. 3(*d*), the punch 53 is moved backward, which enables the water pump shaft 35 to be detached from the dies 51. Thereafter, the joint 45 is formed on one end of the pump shaft 35, and the pump shaft 35 is thermally treated and polished together with the joint 45. The shaft support section 37 may also be thermally treated and polished. The pump shaft 35 is now completed.

Some of the advantages of the water pump, in accordance with the present invention, will now be described. The shaft support section 37 of the cylindrical part 36 is longer than the diameter of the pump shaft 35. This enables the pump shaft 35 to be directly and rotatably attached to the pump body 30 by the long shaft support section 37, rather than having the pump shaft 35 connected to the crankcase 1, as in the background art.

The joint 45 is provided at an end of the pump body 30, which is opposite to the end where the impeller 34 is arranged. The joint 45 removeably engages with the driving shaft 46. This structure enables the pump shaft 35 to be supported at one end thereof, and dispenses with a heavy member, such as a gear, provided on the pump shaft 35. This makes the water pump light weight. Further, this simplifies the manufacturing and repair processes, since the water pump can be made without having to attach the gear onto the pump shaft 35, and since a water pump failure in the impeller section of the water pump can be fixed without having to replace the pump gear 47 operating in conjunction with the crankshaft 6.

The oil collector 42, oil supplying opening 41, and opening 40 collect oil dispersing in the crankcase 1 and guide the oil to the oil supplying groove 38. Each may be in the shape of a duct. This system is effective in reliably supplying lubrication oil to the shaft support section 37, thus prolonging the life of the water pump.

The hollow pump shaft 35 also has several advantages. The pump shaft 35 is light weight and can be easily manufactured. Further, the flange 44 is integrally formed in the center of the pump shaft 35, so that the pump shaft 35 can receive the thrust load of the mechanical seal 48 at the flange 44. Still further, no pins are required to attach the flange 44, and the pump shaft 35 will not be drilled in order to attach pins. The bending process to form the flange 44 can be easily performed and provides excellent precision in positioning the flange 44 on the pump shaft 35.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A water pump for an engine comprising:

a water pump body having an approximately cylindrical support section of a first diameter and a first length, wherein said first length is longer than said first diameter;

a water pump shaft having a first end, a second end, and a second diameter, said second diameter being approximately equal to said first diameter, said water pump shaft lying within said cylindrical support section to be directly and rotatably attached to said water pump body;

a water pump impeller included proximate said first end;

an engaging portion included proximate said second end for causing said water pump shaft and said water pump impeller to rotate relative to said water pump body; and a flange attached to an approximate center of said water pump shaft.

2. The water pump according to claim 1, wherein said water pump shaft is hollow.

3. The water pump according to claim 1, further comprising:

an oil supplying groove formed along at least a portion of said first length of said cylindrical support section for supplying lubricating oil to the rotatable attachment between said water pump shaft and said water pump body.

4. The water pump according to claim 3, further comprising:

an opening on an edge of said water pump body; and a duct formed in said water pump body communicating said opening to said oil groove to supply the lubricating oil to said oil supplying groove.

5. The water pump according to claim 1, further comprising:

a washer disposed between said flange and said water pump body.

6. The water pump according to claim 1, wherein said flange is integrally formed as a part of said water pump shaft.

7. The water pump according to claim 6, wherein said water pump shaft is hollow and wherein said flange is integrally formed as a part of said water pump shaft by a bending process.

8. An engine comprising:

a crank case;

a crank shaft rotatably mounted in said crank case;

a driven member interacting with said crank shaft to rotate in response to rotation of said crankshaft;

a first engaging member connected to said driven member to rotate therewith;

a water pump body attached to said engine;

a water pump shaft having a first end and a second end, said water pump shaft being directly and rotatably attached to said water pump body;

a water pump impeller included proximate said first end; and a second engaging member included proximate said second end, said second engaging member being engaged by said first engaging member to cause said water pump shaft and said water pump impeller to rotate in response to rotation of said first engaging member, wherein said second engaging member is a notch formed in said second end of said water pump shaft, and wherein said first engaging member is a protruding member adapted to mate within said notch.

9. The engine according to claim 8, wherein said driven member is a gear.

10. The engine according to claim 9, wherein said water pump body includes an approximately cylindrical support section of a first diameter and a first length, said first length being longer than said first diameter; said water pump shaft having a second diameter, said second diameter being approximately equal to said first diameter, said water pump shaft lying within said cylindrical support section to be directly and rotatably attached to said water pump body.

11. The engine according to claim 10, further comprising:

an oil supplying groove formed along at least a portion of said first length of said cylindrical support section for supplying lubricating oil to the rotatable attachment between said water pump shaft and said water pump body.

12. The engine according to claim 11, further comprising:

an opening on an edge of said water pump body;

a duct formed in said water pump body communicating said opening to said oil supplying groove to supply the lubricating oil to said oil supplying groove; and an oil supplying reservoir within said crank case communicating with said opening.

13. The engine according to claim 8, wherein said water pump shaft is hollow.

14. A method of forming a water pump shaft of a water pump comprising the steps of:

providing a die with a cylindrical opening of a first diameter formed therein; a punch having a circular groove formed in an end thereof with a protruding cylindrical portion inside the circular groove, the cylindrical protruding portion having a second diameter; and a hollow shaft with a third outer diameter approximately equal to the first diameter and a fourth inner diameter approximately equal to the second diameter;

inserting one end of the hollow shaft into the circular opening of the die;

inserting the cylindrical protruding portion into the hollow shaft until the hollow shaft seats into the circular groove;

moving the punch toward the die;

inserting the cylindrical protruding portion into the circular opening; and bending the hollow shaft in a radial direction at a point where the hollow shaft enters the die.

15. The method according to claim 14, wherein said bending step includes bending the hollow shaft in the radial direction completely around a circumference of the hollow shaft.

16. The method according to claim 15, further comprising the step of:

folding the hollow shaft back onto itself to form a flange completely around the circumference of the hollow shaft.

17. The method according to claim 16, wherein the flange is located in approximately a center of a length of the hollow shaft.

18. The method according to claim 16, wherein the cylindrical opening has a depth and the cylindrical protruding portion has an extension length, and the depth is greater than the extension length.

19. A water pump for an engine comprising:

a water pump body having an approximately cylindrical support section of a first diameter and a first length, wherein said first length is longer than said first diameter;

a water pump shaft having a first end, a second end, and a second diameter, said second diameter being approximately equal to said first diameter, said water pump shaft lying within said cylindrical support section to be directly and rotatably attached to said water pump body;

a water pump impeller included proximate said first end; and a notch formed in said second end of said water pump shaft for engaging with a protruding member adapted to mate within said notch for causing said water pump shaft and said water pump impeller to rotate relative to said water pump body.

20. The water pump according to claim 19, further comprising:

a flange attached to an approximate center of said water pump shaft.

21. The water pump according to claim 20, wherein said flange is integrally formed as a part of said water pump shaft.

* * * * *